United States Patent [19]

Trethewey

[11] Patent Number: 4,826,242

[45] Date of Patent: May 2, 1989

[54] STADIUM CHAIR GARMENT

[76] Inventor: Suzanne S. Trethewey, 49511 North Dr., Plymouth, Mich. 48170

[21] Appl. No.: 233,504

[22] Filed: Aug. 18, 1988

[51] Int. Cl.[4] ..... A47C 9/06

[52] U.S. Cl. ..... 297/17; 2/69; 297/184

[58] Field of Search ..... 297/17, 184; 2/69

[56] References Cited

U.S. PATENT DOCUMENTS 2,146,400 2/1939 Maker et al. ..... 2/69
4,674,631 6/1987 Williams ..... 297/118 X
4,687,248 8/1987 Ross et al. ..... 297/17 X
4,753,483 6/1988 Beier ..... 297/465
4,784,433 11/1988 Purnell-Ayres ..... 297/184

FOREIGN PATENT DOCUMENTS 402953 9/1924 Fed. Rep. of Germany ..... 2/69

*Primary Examiner*—James T. McCall
*Attorney, Agent, or Firm*—Charles W. Chandler

[57] ABSTRACT

A fabric protective garment for the purpose of, but not restricted to, use in an outdoor stadium for enclosing the back torso, lap and leg portions of the user.

5 Claims, 1 Drawing Sheet

STADIUM CHAIR GARMENT

BACKGROUND OF THE INVENTION

This invention is related to protective garments for enclosing the lower portion of a user in an outdoor environment, such as a stadium or the like. More particularly to such a garment which either can be opened to permit a user to sit on the garment and a chair or the like, and partially wrapped around the back torso, lap and leg portion of the user's body; or folded into a compact configuration for carrying.

Protective garments are commonly used for enclosing the lower portion of a user in a stadium or the like, such as spectators at outdoor sporting events. Typically such garments comprise a somewhat tubular garment in which the user places his legs. Such garments are illustrated in U.S. Pat. No. 3,798,676 which issued Mar. 26, 1974 to Larry W. Shanks and Tillman D. O'Brien, Jr.; and U.S. Pat. No. 3,597,764 which issued Aug. 10, 1971 to Harry B. Povey.

SUMMARY OF THE INVENTION

The broad purpose of the present invention is to provide a protective garment for enclosing the back torso, lap and leg portion of the user's body while sitting in a stadium chair or the like, and having a series of foldable panels that can be wrapped around both the shoulders of the user's body and the user's legs and lap. When not being used, the panels can be folded to a generally parallel position and retained by a pair of fasteners so that the garment can be easily carried by a strap.

Still further objects and advantages of the invention will become readily apparent to those skilled in the art to which the invention pertains upon reference to the following detailed description.

DESCRIPTION OF THE DRAWING

The description refers to the accompanying drawing in which like reference characters refer to like parts throughout the several views, and in which.

DESCRIPTION OF THE PREFERRED EMBODIMENT

Figure 1:
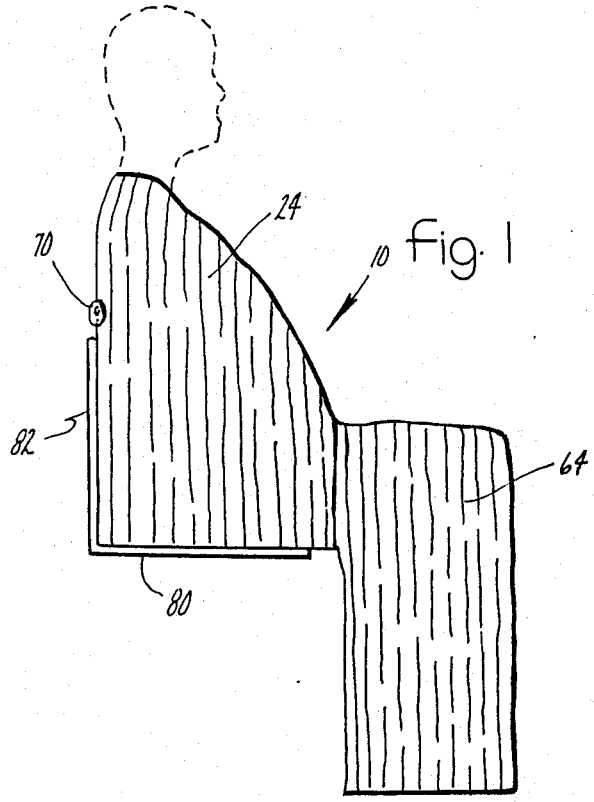
FIG. 1 is a side view illustrating the manner in which the preferred stadium chair garment is disposed when in use.

Referring to the drawing, a preferred stadium chair garment 10 comprises a generally rectangular seat panel 12 stitched along a forward fold line 14 to form a forward edge, stitched along a rearward fold line 16 to form a rearward edge, and stitched along a pair of side edges 18 and 20.

A generally rectangular back panel 22 has a lower edge stitched along fold line 16 so as to be connected to the seat panel. The back panel has a width corresponding to the width of the seat panel and a height about 10 inches taller than the seat panel is deep. The back panel is foldable about fold line 16 from a raised position, illustrated in FIG. 3. That portion of back panel 22 that is longer than the distance between fold lines 14 and 16 can be folded between the back and seat panels when the back panel is folded down for carrying or storage.

A side arm panel 24 having a bottom edge 26, a rear edge 28 and a forward edge 30 has its bottom edge stitched to right side edge 18 of the seat panel. Rear edge 28 of the side arm panel is stitched to the back panel to form a fold line along edge 28.

Figure 3:
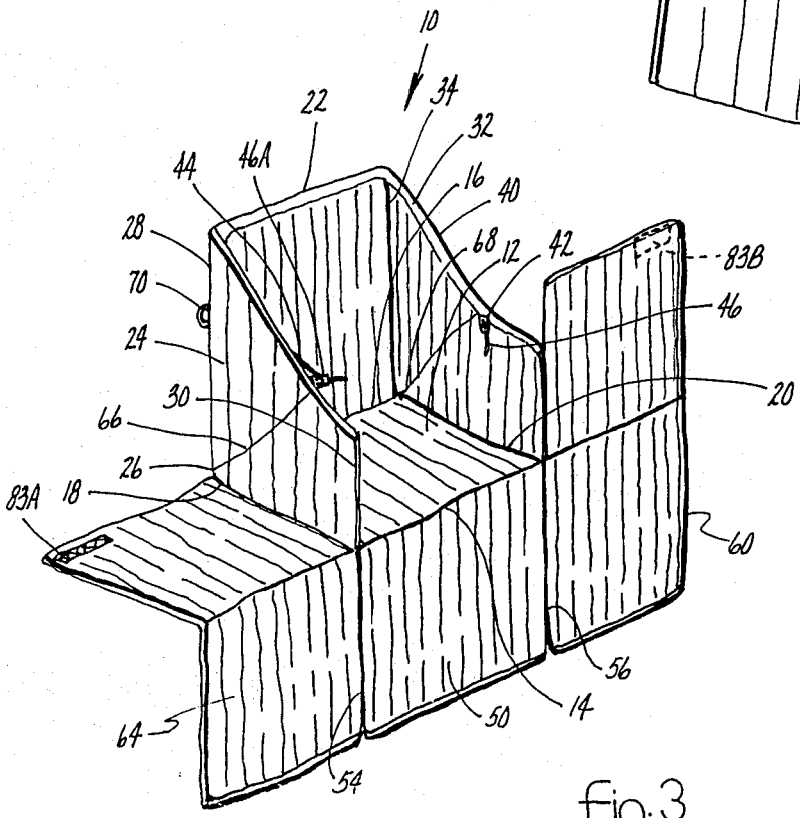
FIG. 3 is a perspective view illustrating another view of the garment, open and unoccupied.

Side arm panel 32 has a lower edge stitched along the left side edge 20 of the seat to form a fold line. Side arm panel 32 is stitched along the left side edge 34 of the back panel to form a vertical fold line as illustrated in FIG. 3. Side arm panel 32 is identical to side arm panel 24 except for a right and left hand relationship.

The two side arm panels and the back panel are stitched to form a sleeve 40 that extends from an opening 42 along the top edge of side arm panel 32, the full length of the top edge of rear panel 22 and down along the top edge of side arm panel 24 to opening 44. A drawstring 46 is disposed in both the sleeve and the openings at the opposite ends of the sleeve so that the user, while sitting on the seat panel, can draw the two side arm panels about the neck and shoulders. Clips 46A and 46B, at the ends of the drawstring, hold the garment as tight as needed to fit the user. Once set, the garment holds its shape even though she leaves or returns to her seat.

A lower leg panel 50 forms a continuation of the seat panel and is stitched along fold line 14 along the upper edge of panel 50. Panel 50 has a pair of side edges 54 and 56 separated by a width that is the same as the width of the seat panel. The leg panel has a generally rectangular configuration corresponding to the dimensions of the seat panel so that the leg panel can be folded up around fold line 14 into a position between the seat panel and the back panel.

A left rectangular side leg panel 60 is stitched along the left side edge 56 of the lower leg panel to form a fold line. Side leg panel 60 has a height between its top and bottom edges that is double the height of the lower leg panel, and a width that corresponds to the width of the lower leg panel.

Similarly, a rectangular right side leg panel 64 has a width corresponding to the width of the lower leg panel and a height that is double that of the lower leg panel. Side leg panel 64 is stitched along the right side edge of lower leg panel 54 to form a fold line.

Figure 2:
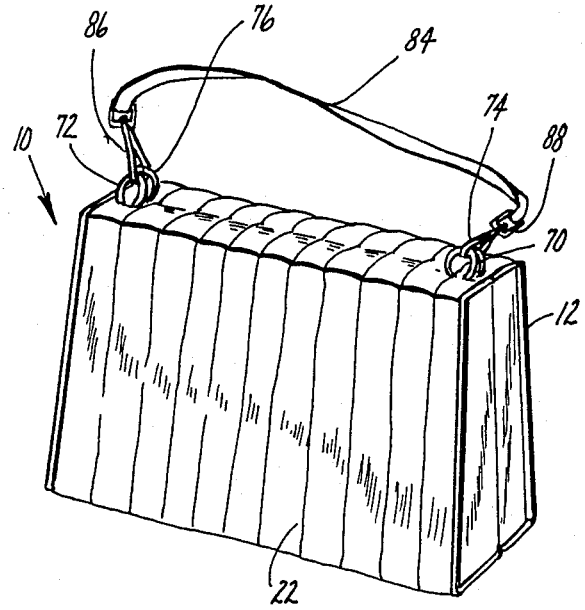
FIG. 2 is a view illustrating the stadium chair garment folded so that it can be easily carried by a strap.

Referring to FIGS. 1–3, a pair of rings 70 and 72 are attached, as by stitching, along the opposite side edges of the back panel.

A second set of rings 74 and 76 are attached, as by stitching, to the underside of the seat panel at the intersection of fold line 14 and the side edges.

Since the back panel has a height greater than the depth of the seat panel, rings 70 and 72 are attached below the top edge of the back panel a distance from fold line 16 that corresponds to the distance of rings 74 and 76 from the same fold line.

In use, the seat panel may be mounted on a stadium chair 80, as illustrated in FIG. 1, having back-supporting structure 82. The user can sit on the seat panel and by pulling on the drawstring, draw the side panels around the shoulders of her body. She may then fold the two side leg panels over her lap and legs to protect them. The two side leg panels may be temporarily fastened together around her lap by complementary hook and loop fasteners 83A and 83B so that the user can stand and the garment will remain fastened around her body and will not fall to the ground.

For storage or carrying, the two side leg panels 60 and 64 are folded into the seat panel and against the lower leg panel along fold lines 54 and 56, respectively. The side leg panels and the lower leg panel are then folded up along fold line 14 so that they are parallel with and laid on the seat panel.

The two upper side arm panels 24 and 32 are then folded inwardly along fold lines 66 and 68 so that the back panel folds down toward the seat panel. The upper edge of the back panel is folded along a line extending between rings 70 and 72, as illustrated in FIG. 2, in which the entire portion of the garment is folded between the back panel and the seat panel. A strap 84 has a snap 86 connected to rings 72 and 76, and a snap 88 connected to rings 70 and 74 so that the entire device can be carried by hand.

The garment is preferably formed of a nylon exterior which is lightweight, durable, and wind and rain resistant. A foam pan in the center provides comfort. The garment has a blanket or nylon interior for warmth. The garment occupies little space and can be either easily opened or collapsed.

Having described my invention, I claim:

1. A protective garment for spectators in outdoor stadiums and the like, comprising:

a generally rectangular, flexible seat panel having a front edge, a rear edge, and left and right side edges;

a generally rectangular, flexible back panel having a top edge, a bottom edge, and right and left side edges, and a width between the right and left edges corresponding to the width between the right and left side edges of the seat panel, the bottom edge being joined to the rear edge of the seat panel such that the back panel may be raised to a position generally at right angles to the seat panel, or folded to a position adjacent and parallel to the seat panel;

a first flexible upper side arm panel having a bottom edge joined to the right side edge of the seat panel, and a rear edge joined to the right side edge of the rear panel so as to be disposed in a raised position, generally at right angles to both the seat panel and the back panel, when the back panel is in said raised position, the first upper side arm panel being foldable to a collapsed position between the back panel and the side panel;

a second flexible upper side arm panel having a bottom edge joined to the left side edge of the seat panel, and a rear edge joined to the left side edge of the rear panel so as to be disposed in a raised position generally at right angles to both the seat panel and the back panels and parallel to the first upper side arm panel when the back panel is in said raised position, the second upper side arm panel being foldable to a collapsed position between the back panel and the seat panel;

a flexible, generally rectangular lower leg panel having a right side edge and a left side edge and a width between said right and left side edges corresponding to the width of the seat panel, the lower leg panel having an upper edge joined to the front edge of the seat panel so as to be foldable along said front edge between a lowered position generally at right angles to and below the seat panel, and a raised position generally parallel to the seat panel and adjacent thereto;

a first lower flexible side leg panel, and a second lower flexible side leg panel, the first lower side leg panel being joined to the right side edge of the lower leg panel so as to be foldable to a position overlying the lower leg panel to at least partially enclose the legs of a user seated on the seat panel, and to be foldable with the lower leg panel to said raised position adjacent the seat panel; and a second lower flexible side leg panel being joined to the left side edge of the lower leg panel so as to be foldable to a position overlying the lower leg panel to cooperate with the first lower side leg panel to enclose the legs of a user seated on the seat panel, and to be foldable with the lower leg panel to said raised position adjacent the seat panel.

2. A protective garment as defined in claim 1, including drawstring means mounted on the back panel and the left and right upper side arm panels so that a user disposed on the seat panel can draw the upper side arm panels around the shoulder of her body.

3. A protective garment as defined in claim 1, including first ring means connected to the back panel, and second ring means connected to the seat panel and fastener means for connecting the first ring means to the second ring means to retain the protective garment in a folded position when the back panel and the seat panel are folded and the remaining panels are disposed therebetween.

4. A protective garment as defined in claim 1, including strap means connected to the ring means for carrying the protective garment in said folded position.

5. A protective garment as defined in claim 1, and in which the garment is cut from one piece of a fabric material, and sewn into a unitary structure so as to be self-containing.

* * * * *